US006500292B1

(12) United States Patent
Mossbeck et al.

(10) Patent No.: US 6,500,292 B1
(45) Date of Patent: Dec. 31, 2002

(54) CONVOLUTED SURFACE FIBER PAD

(75) Inventors: Niels S. Mossbeck, Carthage, MO (US); Steven Eugene Ogle, Murfreesboro, TN (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 09/363,726

(22) Filed: Jul. 29, 1999

(51) Int. Cl.[7] ..... B32B 31/00

(52) U.S. Cl. ..... 156/251; 156/219; 156/257; 156/259; 156/271; 264/160; 264/163; 264/284; 442/366

(58) Field of Search ..... 264/157, 160, 264/163, 284, DIG. 82; 442/366; 428/90, 92; 156/251, 257, 271, 259, 219

(56) References Cited

U.S. PATENT DOCUMENTS

| | | | | |
|---|---|---|---|---|
| 1,815,586 A | | 7/1931 | Robertson et al. | 156/148 |
| 2,689,811 A | | 9/1954 | Frederick et al. | 428/182 |
| 2,902,091 A | * | 9/1959 | Dahle | 83/18 |
| 3,684,140 A | * | 8/1972 | Voss | 225/2 |
| 3,786,701 A | | 1/1974 | Ludwig | 83/861 |
| 4,111,733 A | | 9/1978 | Periers | 156/204 |
| 4,258,093 A | | 3/1981 | Benedyk | 428/85 |
| 4,401,004 A | | 8/1983 | Glans et al. | 83/875 |
| 4,441,396 A | | 4/1984 | Mercier et al. | 83/871 |
| 4,668,562 A | | 5/1987 | Street | 428/218 |
| 4,699,032 A | | 10/1987 | Clark, III | 83/171 |
| 4,965,901 A | | 10/1990 | Normand | 5/710 |
| 5,340,423 A | | 8/1994 | Jacaruso et al. | 156/158 |
| 5,477,573 A | | 12/1995 | Bonaddio et al. | 5/736 |
| 5,636,397 A | | 6/1997 | Boyd et al. | 5/739 |
| 5,702,801 A | | 12/1997 | Chien | 428/181 |
| 5,707,906 A | | 1/1998 | Eschenbach | 442/411 |

FOREIGN PATENT DOCUMENTS

| | | |
|---|---|---|
| DE | 3818252 | 11/1989 |
| JP | 64-6303 | 2/1989 |

* cited by examiner

*Primary Examiner*—Terrel Morris
*Assistant Examiner*—John J. Guarriello
(74) *Attorney, Agent, or Firm*—Wood, Herron & Evans, L.L.P.

(57) ABSTRACT

A non-woven fiber pad having a convoluted surface formed by cutting a non-woven fiber batt having a plurality of low melt synthetic fibers. The non-woven batt is compressed generally toward a cutting device by a pair of counter-rotating drums having convoluted surfaces.

4 Claims, 2 Drawing Sheets

CONVOLUTED SURFACE FIBER PAD

FIELD OF THE INVENTION

This invention relates to non-woven fiber batts. More specifically, this invention relates to a process of forming a non-woven fiber batt into a pad having a convoluted surface.

BACKGROUND OF THE INVENTION

In futons, mattresses and upholstery cushions, different types of filling materials are used to create a range of comfort and height characteristics. There are a number of advantages to be achieved by construction of batts from synthetic, staple fiber material for use in mattresses and upholstery. Such fibers are inherently lightweight and therefore easy to ship, store and manipulate during fabrication. These fibers are also generally less moisture absorbent than natural fibers such as cotton, or cellulosic based synthetic fibers such as rayon. Therefore, products made from these fibers can be maintained in a more hygienic condition and dried with much less expenditure of energy. When subjected to open flame, many of these fibers also tend to melt and drip rather than burn. While some of these fibers give off toxic fumes, the escape of such fumes has been avoided or minimized by encapsulating the batt in a fire retardant or relatively air impermeable casing. In contrast, fibers such as cotton burn rapidly at high heat and generate dense smoke.

Futon furniture in recent years has become a popular alternative to standard upholstered furniture. Futon couches, loveseats and chairs can be repositioned so that the furniture can be used as a bed. Futon beds that do not convert into seats or couches are also commercially available. Traditionally, polyurethane foam has been combined with other types of cushioning materials such as cotton batting, latex rubber, and various man-made fiber products in order to impart the desired comfort characteristics to a final product. With time and use, the various types and combinations of materials take on different degrees of set as a result of compression from the weight of a human body. As is often the case with the softer materials, the final product will take more set over time with continued use. The more set the product takes over time, the more comfort, flexibility and height is lost from the product. Especially with futons, it is desirable to bend, fold and/or roll up a futon mattress to be used as a sofa or for storage when the futon is not used as a flat sleep surface. Yet, when the futon is used as a sleep surface it must be stiff enough to span slats in a bed frame. Preferably, the material used in making the futon would take on little or no set.

Synthetic fiber batts have been used in these products instead of or in addition to polyurethane foam since batts maintain their comfort characteristics over time. However, traditional batts with the desired comfort and height characteristics are generally too stiff to allow a mattress or futon to be easily rolled for storage or folded into a couch. One such batt is shown in U.S. Pat. No. 4,668,562. This batt would be undesirable for use in a futon mattress since in order to create a mattress with desired comfort characteristics a very thick uniform batt would be needed resulting in a product which would be difficult to fold or bend in order to store the mattress.

SUMMARY OF THE INVENTION

It is therefore an objective of the present invention to provide a non-woven fiber pad having improved compression and loft maintenance in order to resist permanent set over time.

It is also an objective of the present invention to provide a non-woven fiber pad that has improved compression and loft characteristics while remaining stiff enough for traditional applications.

It is further an objective of the present invention to provide a process for forming a non-woven fiber pad.

The objectives of the present invention are achieved by forming a non-woven fiber pad with a convoluted surface and an integral relatively thin but stiff base from a non-woven fiber batt made of polyester fibers. The batt is introduced between a pair of counter-rotating drums, at least one of which has a convoluted surface. As the fiber batt is drawn between the counter-rotating drums, the convolutions upon the surface of at least one roller compresses the surface of the non-woven batt in frictional engagement therewith to a greater or lesser degree depending on the degree of surface relief of the roller convolutions.

A heated wire is placed generally parallel to and between the pair of drums so that as the non-woven batt is drawn between the drums and is compressed by the drum convolutions, the heated wire cuts through the non-woven batt creating a cut-pattern generally mirroring the convolutions on the surface of the drum compressing the non-woven batt. That is, where a drum convolution compresses the batt in the vicinity of the heated wire, the wire passes through the batt at a point nearer to the batt surface which is in contact with the drum convolution. Because the cutting wire is heated, the fiber in the non-woven batt melts at the surface during the cutting operation and bonds to adjacent fibers as the melted surface cools, creating a skin that retains the convoluted pattern.

DETAILED DESCRIPTION OF THE PREFERRED EMBODIMENT

Figure 1:
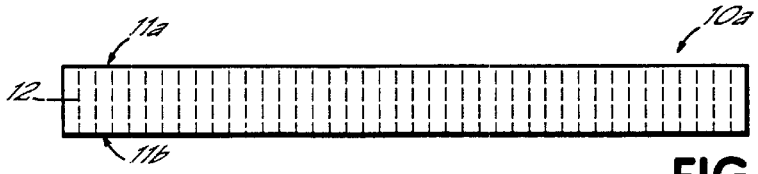
FIG. 1 is a side view of a non-woven batt with vertically oriented fibers.
Figure 2:
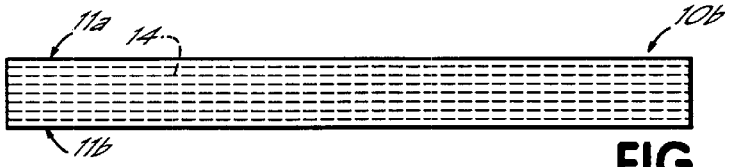
FIG. 2 is a side view of a non-woven batt with horizontally oriented fibers.
Figure 5:
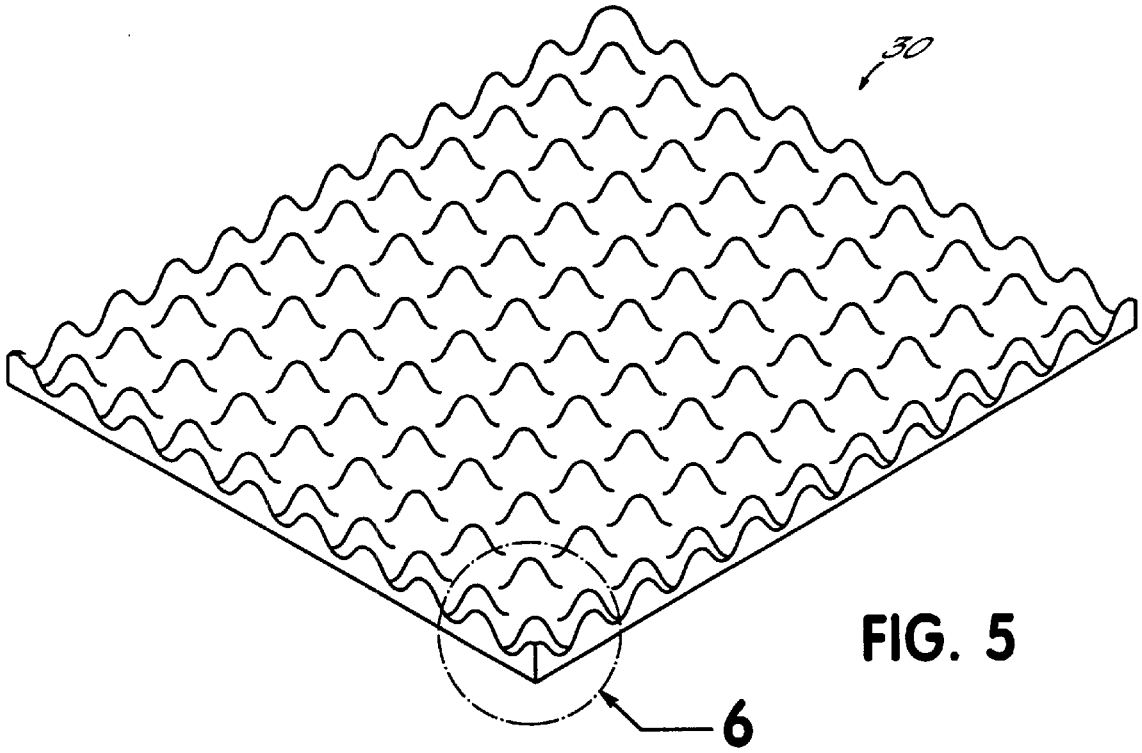
FIG. 5 is a perspective view of a non-woven pad with a convoluted surface.
Figure 6:
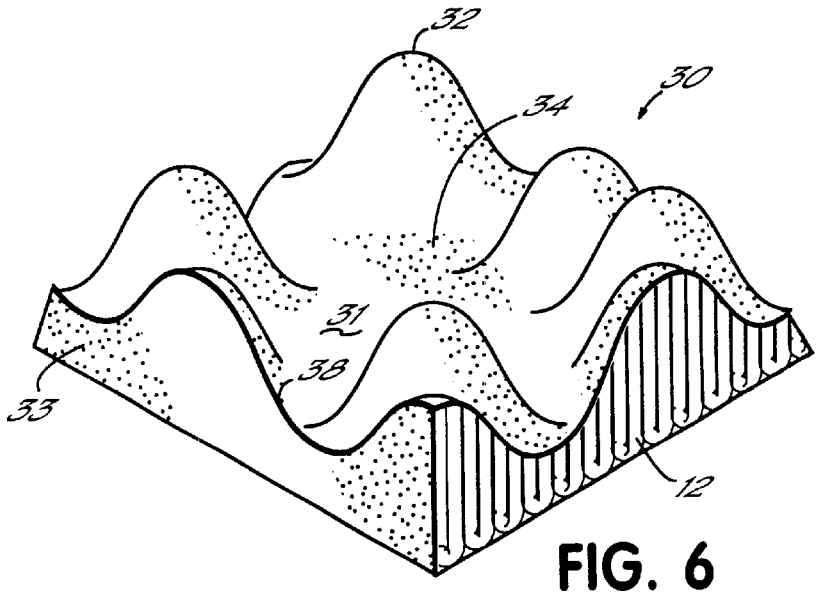
FIG. 6 is a close-up view of the pad of FIG. 5.

As seen in FIGS. 1 and 2, a non-woven fiber batt 10 has an upper surface 11*a* and a lower surface 11*b*. The batt will be described herein with substantially horizontally oriented fiber 10*a*, and with substantially vertically oriented fiber as 10*b*. The batt 10*b* in FIG. 1 is formed from a plurality of substantially vertically oriented fibers 12. In an alternative embodiment (FIG. 2), the non-woven batt 10*a* is formed from a plurality of densified substantially horizontally oriented fibers 14. Densified fiber as used herein refers to fibers having a weight to thickness ratio of at least 57 grams (2 ounces) per 3.8 centimeter (1.5 inch) thickness for a 30.5 square centimeter (1 square foot) area of batt. In the preferred embodiment, the fibers 12, 14 are polyester fibers having a melting point in the range of about 189°–206° C. (300°–330° F.). However, other synthetic fibers known in the art also may be used, such as polypropylene, that have melt ranges close to or below the above-specified range. Also, natural fibers such as camel, llama, wool, cashmere, or cotton can be incorporated with synthetic fibers to produce the batt 10. Because the natural fibers will tend to generate smoke when in contact with a cutting device, e.g., a hot wire 28, the percentage of natural fiber incorporated into the batt 10 should be within a range which will not create an environmental or health hazard during the forming operation. In the preferred embodiment, the non-woven batt 10*b* formed from the vertical fibers 12 is used to form a convoluted pad 30 (FIG. 5), since the vertically oriented fibers 12 have superior convolution 31 retention properties as compared to the horizontally densified fibers 14, as discussed further below. Prior to processing the batt 10 into the pad 30, the non-woven batt 10 has an initial thickness of up to about eighteen inches. The batt 10*a* with horizontally densified fibers 14 is formed by spray bonding the fibers 14 together with an adhesive and then compressing the batt 10*a* by rolling it to create a finished densified bat 10*a,* as is known in the art. In an alternative process of forming the batt 10*a,* the fibers 14 are oven-baked together and then rolled and cooled to densify the batt 10*a.*

The batt 10*b* has a plurality of fibers 12 arranged generally transversely to the horizontal plane of the batt 10*b.* The batt 10*b* may include a blend of different types of fibers 12, e.g., fibers having varying diameter and denier, hollow fibers, solid fibers and crimped fibers. Blending different types of vertically oriented fibers 12 creates dead air spaces to contribute to the resiliency of the convoluted pad 30 and lends to the integrity of the batt 10*b.*

The batt 10*b* is formed using one of the several processes for converting a source of fiber into vertically oriented fibers 12, as is known in the art. The vertically oriented fibers 12 may receive an application of a resin to improve the structural integrity of the batt 10*b,* or may alternatively incorporate a portion of low melting fibers which will melt to bond high melt fibers in the batt 10*b* on application of heat. The peaks of the vertically oriented fibers 12 in batt 10*b* may be brushed to improve the entwining of individual fibers of one peak into adjacent peaks. Adjacent peaks of vertically oriented fibers 12 may be of substantially the same height, or alternatively may have different heights in a repeating pattern. The structure and manufacture of a batt incorporating vertically oriented fiber is described in more detail in U.S. Pat. No. 5,702,801, incorporated herein by reference.

Figure 3:
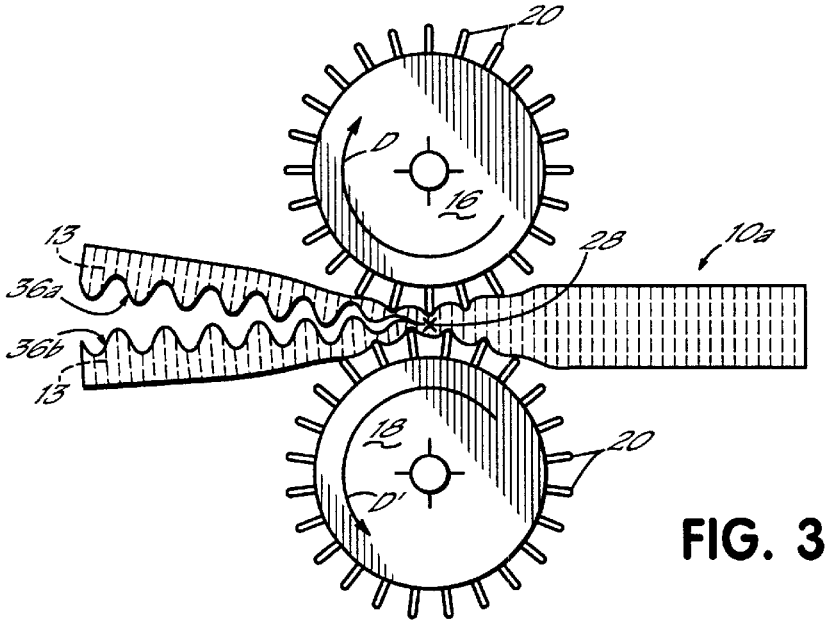
FIG. 3 is a schematic drawing of the present inventive process.
Figure 4:
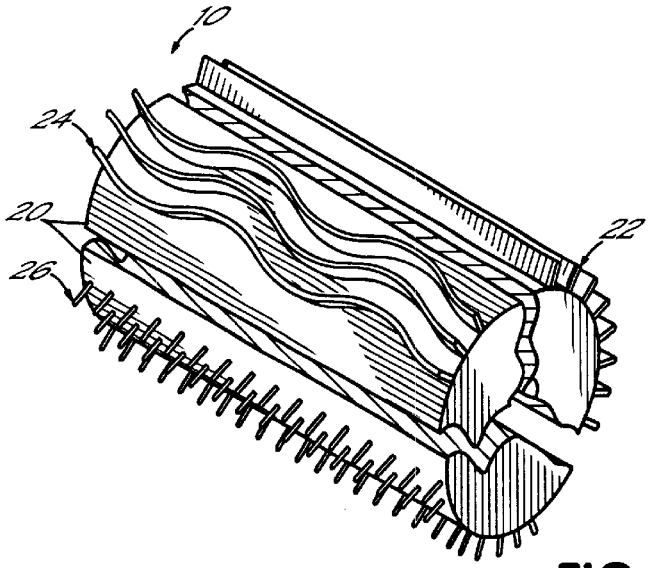
FIG. 4 is a perspective view of a roller with three possible convoluted surfaces.

In the preferred embodiment, the convoluted pad 30 is formed by introducing a leading edge 13 of the batt 10 between a top drum 16 and a bottom drum 18, the drums 16, 18 having opposite rotational directions D, D', as seen in FIG. 3. In the preferred embodiment, the batt 10 is introduced between the drums 16, 18 by a conveyor belt (not shown). Once the conveyor belt introduces the batt 10 between the drums 16, 18, the drums 16, 18 themselves continue to draw the batt 10 as the batt 10 is convoluted. The drums 16, 18 each have a convoluted surface 20 with at least one raised pattern thereon, such as but not limited to a straight edge 22, a waved edge 24, or a plurality of pegs 26, as seen in FIG. 4, that do not intermesh or come in contact with the surface 20 of the opposite drum 16, 18 when the drums 16, 18 rotate. In an alternative embodiment, only one of the drums 16,18 has a convoluted surface 20 in order to convolute one of the upper surface 11*a* and lower surface 11*b* of the batt 10 while the other of the drums 16, 18 does not have a convoluted surface 20 and operates to simply facilitate the drawing of the batt 10 through the drums 16, 18 and compression of the batt 10.

As the non-woven batt 10 is drawn into frictional engagement with the top drum 16 and bottom drum 18, the convoluted surface 20 of either the top drum 16 or bottom drum 18 pushes the upper surface 11*a* or lower surface 11*b,* respectively, towards the opposite drum 18, 16, respectively. In the preferred embodiment, a cutting device, e.g., a hot wire 28 schematically shown as an X, is positioned generally parallel to and between the top drum 16 and bottom drum 18, and between the upper surface 11*a* and lower surface 11*b* of the non-woven batt 10 as the non-woven batt 10 is drawn between the drums 16, 18. As the non-woven batt 10 encounters the hot wire 28, the hot wire 28 cuts through the non-woven batt 10 at a point nearer to the batt surface 11*a,* 11*b,* which is in contact with the convoluted surface 20 to create convolutions 31. It will be understood by those in the art that the drums 16, 18 may be positioned closer to or further away from each other depending on the thickness of the batt 10 to be convoluted, and the depth of the cut made by the hot wire 28. In the preferred embodiment, the hot wire 28 is heated above the melting point of the fibers 12, 14, about 189°–206° C. (300°–330° F.) for polyester, in order to speed cutting. In the preferred embodiment, the convoluted surface 20 of the top drum 16 does not come into contact with or intermesh with the convoluted surface 20 of the bottom drum 18 so the wire 28 does not cut through the upper and lower surfaces 11*a,* 11*b* of the batt 10.

Because the non-woven batt 10 is formed from synthetic fibers 12, 14, with a low melting point, as the hot wire 28 cuts through the non-woven batt 10, the cut surfaces 36*a,* 36*b* are also bonded as the fibers 12, 14 lose their original plastic memory and then reform as a skin 38 as the cut surfaces 36*a,* 36*b* cool. In an alternative embodiment, the non-woven fiber batt 10 may be convoluted and then cut by a rotating bandsaw blade (not shown) located outside of and adjacent to the drums 16, 18.

The product formed by the inventive process is a convoluted pad 30 for use in futons, mattresses, upholstery and the like. The convoluted pad 30 has convolutions 31 generally comprised of peaks 32 and valleys 34 in different patterns and configurations depending upon the convoluted surface 20 of the counter-rotating drums 16, 18. The convolutions 31 remain integral with an un-convoluted thin base 33, i.e., the convolutions 31 and the base 33 are formed from the same batt 10, that will retain a stiffness required for using the pad 30 in items such as sofa cushioning and mattresses. The convoluted pad 30 may be made of either substantially vertically oriented low melt fibers 12 or substantially horizontally oriented densified low melt fibers 14. When the convoluted pad 30 is made from the vertically oriented fibers 12, the peaks 32 have a greater ability to retain their shape when cut by the hot wire 28, because the vertical orientation of fibers 12 resists sloughing off parts of the peaks 32 as convoluted pads 30 made from horizontal fibers 14 tend to do. From the above disclosure of the detailed description of the preferred embodiment and the preceding summary of the preferred embodiment, those skilled in the art will comprehend the various modifications to which the present invention is susceptible. Therefore, I desire to be limited only by the scope of the following claims and equivalents thereof.

We claim:

1. A process of forming a convoluted fiber pad from a non-woven batt incorporating a plurality of synthetic fibers therein, wherein said batt has a leading edge, an upper surface and a lower surface, said process comprising providing said batt:

placing a cutting device generally in front of said leading edge of said batt and generally between said upper surface and said lower surface of said batt;

introducing said leading edge of said batt between a pair of rotating drums, at least one of said drums having a convoluted surface;

moving at least one of said leading edge of said batt and said cutting device to thereby cause contact between said batt and said cutting device.

2. The process according to claim 1, wherein said cutting device is a heated wire.

3. A process of forming a convoluted fiber pad from a non-woven batt incorporating a plurality of synthetic fibers therein, wherein said batt has a leading edge, an upper surface and a lower surface, comprising providing said batt:

placing a heated cutting device generally in front of said leading edge of said batt and generally between said upper surface and said lower surface of said batt;

introducing said leading edge of said batt between a pair of rotating drums, at least one of said drums having a convoluted surface;

moving at least one of said leading edge of said batt and said heated cutting device to thereby cause contact between said batt and said cutting device wherein the heated cutting device at least partially melts some fibers in the non-woven batt; and cooling said fibers which have been at least partially melted, thereby creating a skin upon a convoluted surface of said fiber pad.

4. A process of forming a convoluted fiber pad from a non-woven batt incorporating a plurality of synthetic fibers therein, wherein said batt has a leading edge, an upper surface and a lower surface, comprising providing said batt:

placing a heated cutting device generally in front of said leading edge of said batt and generally between said upper surface and said lower surface of said batt;

moving at least one of said leading edge of said batt and said heated cutting device in a direction to thereby cause contact between said batt and said cutting device;

bonding adjacent fibers in the non-woven batt at one surface of the non-woven batt by exposing the fibers to heat from the cutting device; and cooling the fibers, thereby creating a skin upon a convoluted surface of said fiber pad.

* * * * *

UNITED STATES PATENT AND TRADEMARK OFFICE

CERTIFICATE OF CORRECTION

PATENT NO. : 6,500,292 B1 
DATED : December 31, 2002
INVENTOR(S) : Niels S. Mossbeck and Steven E. Ogle It is certified that error appears in the above-identified patent and that said Letters Patent is hereby corrected as shown below:

Column 4,
Line 54, replace "Therefore, I" with -- Therefore, we --.
Lines 60-61, change "comprising" to -- comprising: --. After "comprising:" start a new line and indent as a subparagraph -- providing said batt --.

Column 5,
Line 9, change "comprising" to -- comprising: --. After "comprising:" start a new line and indent as a subparagraph -- providing said batt; --.

Column 6,
Line 7, change "comprising" to -- comprising: --. After "comprising:" start a new line and indent as a subparagraph -- providing said batt; --.

Signed and Sealed this

Twenty-ninth Day of July, 2003

JAMES E. ROGAN
*Director of the United States Patent and Trademark Office*